United States Patent [19]

Townley

[11] 4,344,844

[45] Aug. 17, 1982

[54] INCLINED STATIC DEOILER AND CONDITIONER FOR TREATING ORE

[76] Inventor: J. O. Townley, P.O. Box 221, Candler, Fla. 32624

[21] Appl. No.: 244,601

[22] Filed: Mar. 17, 1981

[51] Int. Cl.[3] ..... B03D 1/00

[52] U.S. Cl. ..... 209/168; 209/170; 209/1; 210/221.1; 366/143; 366/337; 366/340

[58] Field of Search ..... 209/164, 168, 170, 458, 209/461, 1, 3; 261/123; 366/337, 340, 143; 138/37; 210/221.1

[56] References Cited

U.S. PATENT DOCUMENTS

| | | | |
|---|---|---|---|
| 219,926 | 9/1879 | Eddy | 209/458 |
| 300,479 | 6/1884 | Kennedy | 209/458 |
| 388,659 | 8/1888 | Frank | 209/458 |
| 847,519 | 3/1907 | Sloane | 209/458 |
| 1,297,372 | 3/1919 | Loventhol | 209/168 |
| 1,731,660 | 10/1929 | Harris | 209/458 |
| 1,830,848 | 11/1931 | Miles | 209/458 X |
| 2,152,143 | 3/1939 | Martin | 209/458 |
| 2,793,166 | 3/1957 | Hatch | 366/143 X |
| 3,032,199 | 5/1962 | Sumiya | 209/170 |
| 3,751,009 | 8/1973 | Archer | 366/337 |
| 4,284,499 | 8/1981 | Moudgil | 209/168 X |

FOREIGN PATENT DOCUMENTS

| | | | |
|---|---|---|---|
| 521796 | 8/1953 | Belgium | 261/123 |
| 1159396 | 12/1963 | Fed. Rep. of Germany | 366/337 |
| 2056528 | 3/1981 | United Kingdom | 209/458 |
| 663593 | 9/1977 | U.S.S.R. | 366/337 |

*Primary Examiner*—Robert Halper
*Attorney, Agent, or Firm*—Victor J. Evans & Co.

[57] ABSTRACT

An inclined static deoiler and conditioner for treating ore such as coal, phosphate, and the like which combines with liquid to form a slurry prior to froth floation which includes in combination a trough having plural baffles therein which are oriented to cause turbulence in the slurry. End walls on the trough are provided having an inlet and outlet adapted to fasten to piping in which the maximum flow rate is determined by the piping diameter such that liquid entering in the trough is assured of staying substantially at or below the vertical height of the baffles. The through flow within the device is controlled by angulation of the trough which is variable, and baffle configuration.

9 Claims, 8 Drawing Figures

35°-45°

INCLINED STATIC DEOILER AND CONDITIONER FOR TREATING ORE

BACKGROUND OF THE INVENTION

The following invention relates to an improved method for mineral conditioning and mineral deoiling in association with froth flotation.

Mineral conditioning is a technique in use today for the addition of ammonia or caustic sodia and fatty acids to a "concentrate grade" of minerals prior to froth flotation.

Mineral deoiling is a process of removing oils from concentrated minerals after froth flotation. Typically, the mixing of sulfuric acid and the pulp, as in the case of phosphate is combined to scrub and remove reagents from the pulp.

The following patents appear to reflect the state of the art today in so far as applicant is aware and in so far as they appear to be germane to the patent process: U.S. Pat. Nos. 3,343,674 Zandon et al.; 3,371,779 Hollingsworth et al.

The patent to Hollingsworth et al. teaches the use of a concentration beneficiation of minerals and other particulate matter by froth flotation in which a hydraulic-pneumatic flotation apparatus and method of froth flotation is disclosed including aerated water in a hydraulic compartment in which its uniform distribution and constriction plate provide the necessary flotation.

The patent to Zandon et al. teaches the use of a froth flotation process and apparatus in which batches of the material are put into vats which are exposed to aeration, turbulence, and mixing to provide the flotation.

These conventional processes are actually directed to the froth flotation itself, but the preceding and successive stations in the mineral conditioning and deoiling are the same structure for mixing acids and oils to the pulp. That is the mixing of these substances to the pulp in the prior art comprise introducing by impeller vanes and aeration a thorough mixing of the material to the pulp.

The instant application is directed to and involves the feed of pulp and reagents into a vessel containing a variable arrangement of sloped baffles. The pulp and reagents are mixed thoroughly with a folding action by gravity and exit a discharge outlet of the unit without the requirement of mechanized motion. The device according to the instant application treats designated particle surfaces with sufficient vigor to detach loosely adherent coatings. While prior art impellers are required to maintain the solids in suspension in the pulp permitting the reagents to coat particle surfaces, plural conditioning tanks are sometimes necessary to provide an even coat on all particle surfaces.

SUMMARY AND OBJECTS OF THE INVENTION

Accordingly, this invention has as its primary object the treatment of pulp in concentrate grade in which substantially less power per ton of pulp is required.

Accordingly, it is a further object of this invention to provide a device in which the capital costs per ton of pulp treated is lower because of the requirement of fewer numbers of machines, smaller floor area or building space required, and low equipment costs.

It is yet a further object of this invention to provide a device of the character described above in which the maintenance cost per ton of pulp treated is lower because of the elimination of electrical hardware and moving parts when contrasted with the prior art.

It is a further object of this invention to reduce the total cost of chemicals required to provide the conditioning by providing a mechanism in which the quality of the agitation is enhanced.

It is yet a further object of this invention to provide a device of the character described above in which the overall process is more simply controlled by the elimination of variable mechanical movements.

It is yet a further object of this invention to provide a device of the character described above in which plural units can be harnessed in tandem if so desired to provide flexibility and adding chemicals in stages for optimized agitation prior to subsequent mixing, should the pulp require processing which varies or requires additional residence time depending upon the specific application.

It is a further object of this invention to provide a device of the character described above which is relatively inexpensive to manufacture, extremely durable in use and longevity, and extremely safe to use.

It is a further object of this invention to provide a device of the character described above which can benefit from mass production techniques thereby providing cost benefits not contemplated by the prior art.

These and other objects will be made manifest when considering the following detailed specification when taken in conjunction with the drawing figures.

BRIEF DESCRIPTION OF THE DRAWING FIGURES

BRIEF DESCRIPTION OF THE PREFERRED EMBODIMENT

Figures 1, 2, 7, 8:
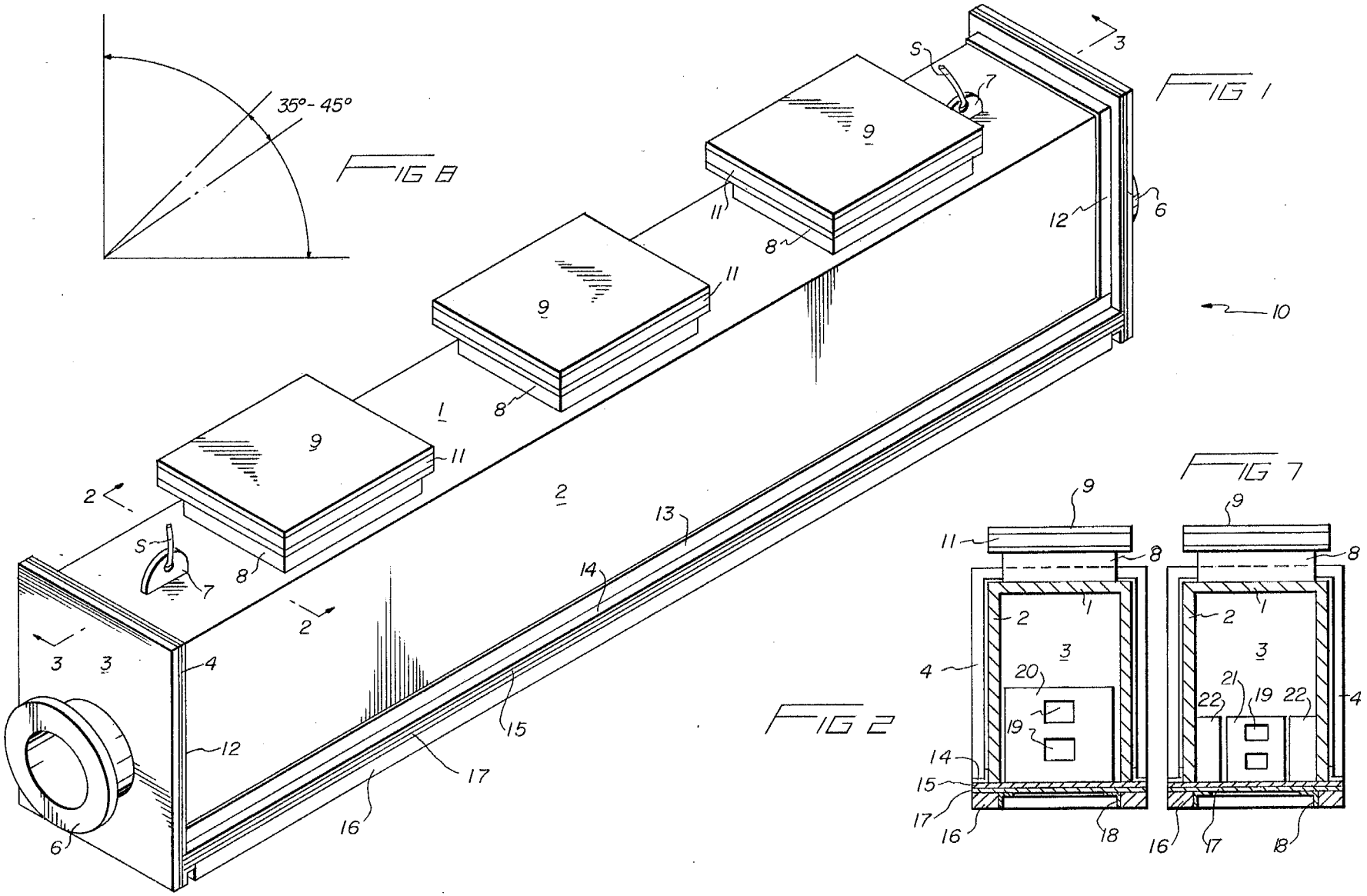
FIG. 1 is a perspective view of the apparatus according to the present invention.
FIG. 2 is a sectional view taken along lines 2—2 of FIG. 1.
FIG. 7 is a section view taken along lines 2—2 of FIG. 1 showing a second embodiment.
FIG. 8 is a graphical depiction of optimum angles for the inclination of the trough.

Referring to the drawings now wherein like reference numerals refer to like parts throughout the various drawing figures, reference numeral 10 is directed to the inclined static deoiler and conditioner according to the present invention.

This device 10 can generally be regarded as having a trough means including a bottom wall 15, vertically upstanding side walls 2 affixed to the bottom wall, and a top wall 1 so that the overall appearance and general configuration of the trough is of an elongate rectangular hollow.

The trough is provided with an inlet and outlet each symmetrically formed and defined as having an inner plate 4 to which is affixed on an outer face thereof a flanged pipe 5, 6 coupling having parallel wall 3, and a perimetral flanged support 12. The inlet pipe P communicates with an inlet having substantially the same dimension 5 as the pipe diameter, and a flanged end 6 for affixing to the pipe.

As shown especially well in FIGS. 1, 2 and 7, the areas adjacent the bottom and side walls of the trough are reinforced with flanges 14, and 18 on respective top outer and lower inner faces, first and second bottom walls 15 and 17 respectively, and a pair of spaced parallel support bars 16 running the longitudinal extent of the trough for additional rigidity and support.

Figure 3:
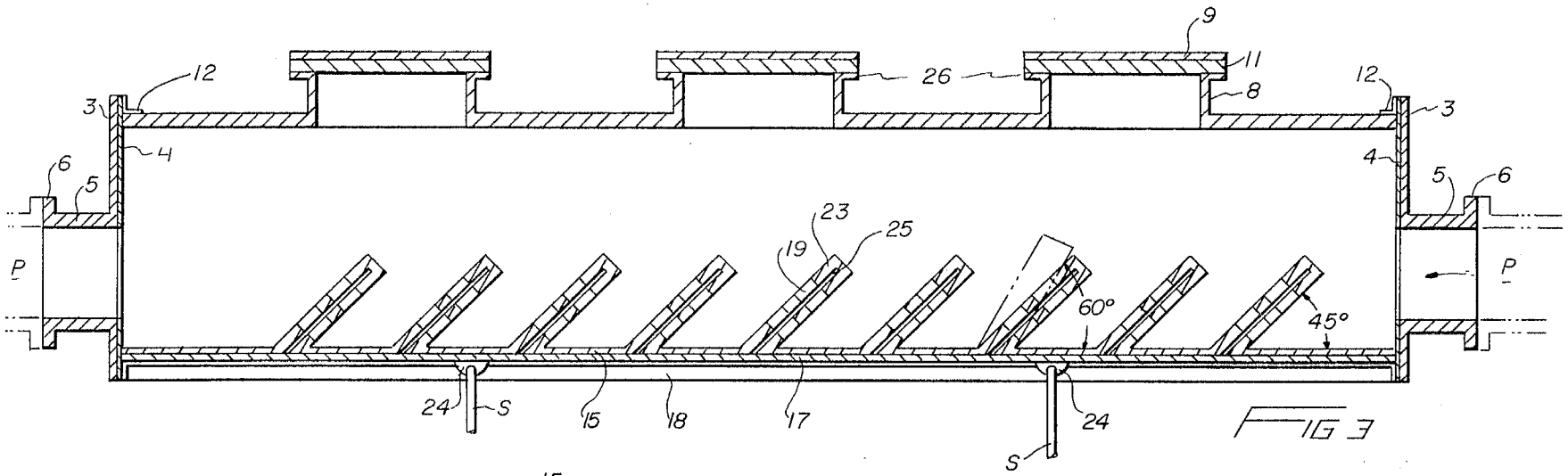
FIG. 3 is a sectional view taken along lines 3—3 of FIG. 1.

The top face of the trough is provided with a plurality of inspection port means 9 which are defined by at least one opening in the top face 1 of the trough around which an upwardly extending stack 8 is provided that includes a top terminus defined by a perimetral flange 26. A cover 9 is provided having a downwardly turned lip 11 for snug engagement with the stack 8, as best seen in FIG. 3.

Means to angulate the trough relative to the horizontal plane are provided which in one form of the invention comprises a plurality of ears 7 on the top wall 1 of the trough from which a sling or other support S is removably attached.

A further support S is provided for connection on the lower face 17 of the trough defined by further ears 24. It is contemplated that the length of the support members be varied so as to vary the angle of declination of the trough from the inlet port to the outlet port as suggested in FIG. 8 whereby the preferred angle of installation of the trough is between 35 and 45 degrees, a greater angulation provides less residence time of the pulp slurry within the trough, and an angulation less than the preferred range provides a greater residence time. In this regard, it is to be noted that the inlet and outlet dimensions of the conduits are such that the diameter thereof is substantially the same as the vertical height of baffles contained within the trough so that the flow rate causes agitation and treatment of the pulp in such a manner that the liquid level does not extend substantially above the vertical height of the baffles.

Figure 4:
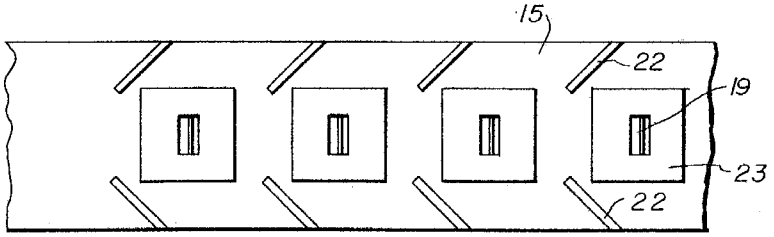
FIG. 4 is a top plan view of the floor of a trough shown in the previous figures.
Figure 5:
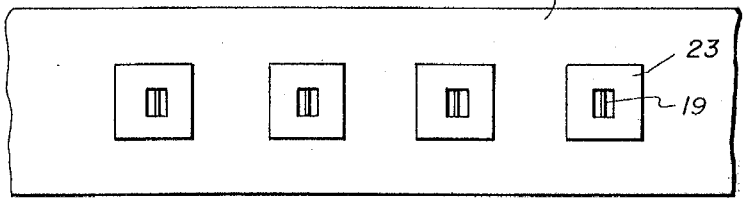
FIG. 5 is a view similar to FIG. 4 showing a second embodiment.

The baffles themselves can take several forms as shown in the various drawing figures. First baffles are provided affixed to a central area of the trough bottom 15, and it is desired that the angulation of the baffles relative to the pulp inlet range between 45 and 60 degrees in a preferred form. FIG. 3 also shows that the baffles 23 are formed of two ply construction so that a plurality of spaces 25 exist between each ply whereby the injection of air if so desired can be easily effected therein, but also when an opening 19 that extends through the baffles is included, the space 25 between the baffle plys provides further turbulence. As shown in FIG. 4 for example and in FIG. 7, further baffles 22 are provided which are affixed mainly to the side walls 2 of the trough to redirect and refocus the slurry back toward a central longitudinal area of the trough to encourage mixing through the centrally disposed baffles 23.

Figure 6:
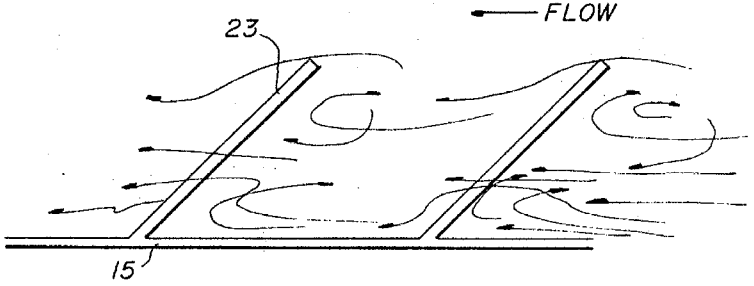
FIG. 6 is a schematic representation of the turbulence associated with the baffles according to the present invention.

FIG. 6 is a schematic depiction of the turbulence associated with the baffle arrangement as discussed in the preceding drawings and it clear therefore that given the flow rate parameters of the inlet and outlet pipes, the flow can be characterized as a vigorous agitation and folding motion in which substantially none of the pulp or slurry extends above the vertical height of the baffles.

The above discussed structure lends itself to vigorous agitation in mixing of concentrated grad pulps such as coal, phosphates, and the like without the requirement for additional agitation to improve the mixing, due primarily to the baffles and vertical inclination of the trough. However, in some instances it may be desired to augment the agitation as by the provision of overhead water jets or air nozzles which are placed beneath the liquid level of the pulp. The viewing portals on the top face make such inclusions extremely easy. In addition, some benefit may be obtained from providing vibration. It should be appreciated however that the residence time of the pulp for agitation is influenced by the length of the unit and size, the baffle configuration, and the installation angle, all of which are variable in the apparatus according to the present invention.

It is contemplated that the number of baffles may range from 9 to 30 and the baffle sizes may differ for each application. Openings are provided in the baffles to provide further agitation, and the number of rows baffles are either 1, 3 or any odd number thereafter. The viewing port is also extremely useful in assisting not only inspection but cleaning out the troughs as is necessary. The components are preferable fabricated from mild steel plate and pipe which are thereafter lined with an abrasion resistant, corrosion resistant coating such as Towniprene ®.

The following table shows one typical application of conditioning before froth flotation and deoiling.

| APPLICATIONS | PULP: PHOSPHATE |
|---|---|
| Conditioning | |
| Optimum Feed: | 70–72% Solids (By Weight)<br>300 Tons per Hour Maximum<br>900 GPM Slurry |
| Ammonia or Caustic Sodia<br>Fatty Acids | 8.8–9.2 PH |
| Deoiling | |
| Optimum Feed | 70–72% Solids (By Weight)<br>300 Tons per Hour Maximum<br>900 GPM Slurry |
| Sulfuric Acid: | 3–5 lbs. @ 98% per ton of feed |

It is to be noted that the mixing of the acids to the pulp cause the components in the pulp to sink while the oiling causes other substances to float thereby facilitating separation for phosphate, coal, and other ores.

Moreover, having thus described the invention it should appreciated that numerous structural modifications are contemplated as being a part of this invention as set forth hereinabove and defined hereinbelow by the claims.

What is claimed is:

1. An inclined static deoiler and conditioner for treating ore in liquid prior to and after froth flotation comprising in combination:

a trough means, first baffle means oriented to cause turbulence on the liquid/ore in said trough said first baffle means formed from two ply material provided with an interior air space between said plies, end walls on said trough having an inlet and an outlet adapted to fasten to piping, and means to angulate said trough to alter the liquid flow rate.

2. The device of claim 1 wherein said outlets are equally dimensioned relative to the vertical height of said baffle means so that the liquid/ore flow stays substantially at or below said vertical height.

3. The device of claim 2 wherein said first baffle means are inclined toward said inlet.

4. The device of claim 3 wherein inspection port means are provided on a top panel of said trough to view the flow within said trough and provide access for material addition and cleaning.

5. The device of claim 4 wherein said first baffle means includes openings therethrough and said first baffle means are on a trough floor.

6. The device of claim 5 wherein second baffle means are included comprising plates on floor and side walls of said trough thereby directing flow to a central longitudinal area of said trough.

7. The device of claim 6 wherein said means to angulate said trough include ears on bottom and top outer faces of said trough to fasten support means thereto.

8. The device of claim 7 wherein said trough means are of substantially rectangular configuration and said end walls are affixed thereto by flanges.

9. The device of claim 8 wherein said side and bottom walls are reinforced with flanges under which a pair of spaced parallel support bars are provided.

* * * * *